United States Patent [19]

Bayer

[11] Patent Number: 4,544,831

[45] Date of Patent: Oct. 1, 1985

[54] HOT WARNING DEVICE FOR COOKING APPARATUS

[75] Inventor: Helmut Bayer, Vienna, Austria

[73] Assignee: Electrovac Fabrikation elektrotechnischer Spezialartikel Gesellschaft m.b.H., Vienna, Australia

[21] Appl. No.: 628,688

[22] Filed: Jul. 6, 1984

[30] Foreign Application Priority Data

Jul. 7, 1983 [AT] Austria ..... 2508/83

[51] Int. Cl.[4] ..... H05B 3/68

[52] U.S. Cl. ..... 219/449; 219/464; 219/512; 337/354; 337/383; 337/394

[58] Field of Search ..... 219/441, 442, 449, 450, 219/451, 453, 464, 512; 337/354, 383, 393, 394

[56] References Cited

U.S. PATENT DOCUMENTS

| | | | |
|---|---|---|---|
| 2,705,747 | 4/1955 | Strange | 337/394 |
| 2,924,700 | 2/1960 | Huffman | 219/442 |
| 2,990,716 | 7/1961 | Butts | 337/393 UX |
| 3,004,123 | 10/1961 | Cannon | 337/393 |
| 3,562,692 | 2/1971 | Bletz et al. | 337/354 |
| 3,573,700 | 4/1971 | Schmitt | 337/347 |
| 3,906,424 | 9/1975 | Clancy et al. | 337/394 |
| 3,921,198 | 11/1975 | Pohl | 337/354 X |
| 4,215,332 | 7/1980 | Wharton | 337/394 |
| 4,347,432 | 8/1982 | Gössler | 219/449 |
| 4,430,558 | 2/1984 | McWilliams | 219/449 |

FOREIGN PATENT DOCUMENTS

| | | | |
|---|---|---|---|
| 2748109 | 5/1979 | Fed. Rep. of Germany | 219/449 |
| 700826 | 1/1931 | France | 337/394 |
| 434508 | 10/1967 | Switzerland | 337/394 |

*Primary Examiner*—Volodymyr Y. Mayewsky
*Attorney, Agent, or Firm*—Martin A. Farber

[57] ABSTRACT

In a cooking and heating apparatus, a device for warning personnel of dangerously hot temperature is incorporated within the structure of a thermostat which has a switch for regulating the flow of electric current to a heating element of the apparatus. The thermostat includes a push rod mechanically coupled to a finger-like termination which extends through an aperture in an arm of the regulating switch to engage the arm of a further switch used in activating a warning indication. A collar on the termination engages the arm of the regulating switch subsequent to the activation of the further switch by the rod. The rod expands with increasing temperature and, thereby, initiates the warning at a lower temperature than the temperature of the power cut off by the regulating switch.

14 Claims, 4 Drawing Figures

Figure 4:
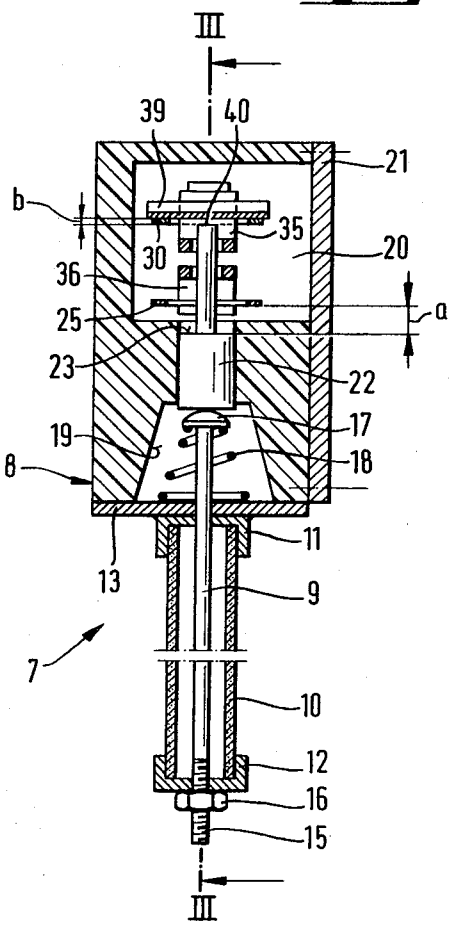

Fig. 1
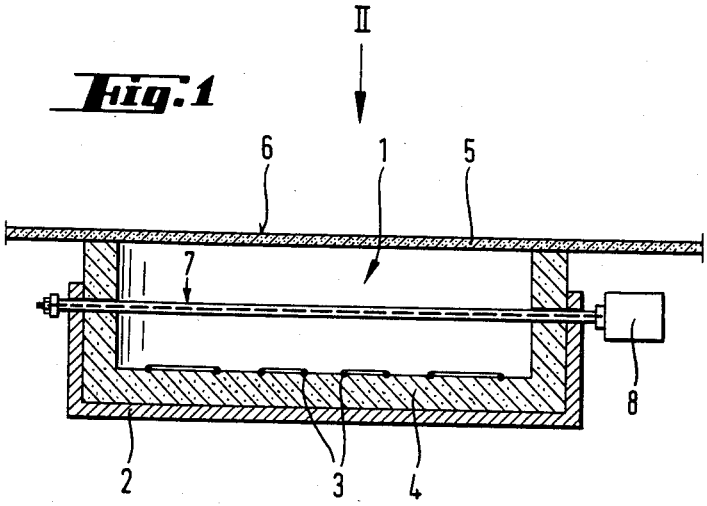
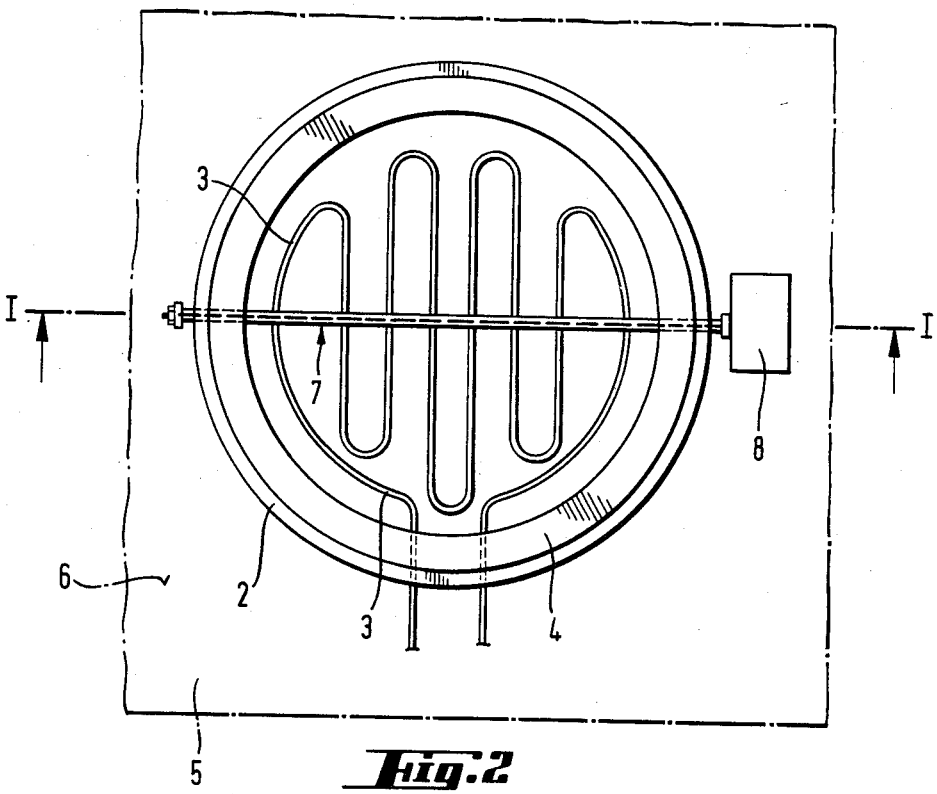
Fig. 2

HOT WARNING DEVICE FOR COOKING APPARATUS

The present invention refers to a device for a hot warning and for regulating or controlling the temperature of radiation or contact heating bodies of electrical cooking apparatus in combination with cooking surfaces consisting of metal, glass ceramics or the like, in which a temperature sensor is arranged between the heating body and the cooking surface in order to regulate or limit the temperature of the heating body, said temperature sensor having a rod consisting of a material of a high coefficient of thermal expansion arranged in a tube of a material of low coefficient of thermal expansion, the one end of the rod being in communication via a transmission member with a switch system which serves for regulating or limiting the temperature of the heating body and for a signalling device.

Electric cooking apparatus with radiation or contact heating bodies have the disadvantage that, after the heating current has been turned off, the cooking surface requires a relatively long time until it is completely cool so that there is a danger of burning oneself if one touches the cooking surface. This danger is present, in particular, in those heating apparatus in which one or more heating bodies are covered by a metal plate which covers all the heating bodies, a glass-ceramic plate of very low coefficient of expansion or the like by which there is created a cooking surface which represents a continuous flat surface of the cooking field. This cooking surface looks like the surface of a tabletop without it being evident whether or not one can touch it without danger of burning oneself. The heating bodies which are arranged below the cooking surface may be contact heating bodies or radiation heating bodies, the latter representing heating bodies without metallic protective covering of the heating conductor and in connection with which the heat is given off to the cooking zone predominantly by radiation. In cooking apparatus having several heating bodies, zones of different high temperatures occur on the cooking surface depending on the heating of the individual heating bodies. If a heating body is now heated then the cooking zone associated with it assumes a high temperature while, on the other hand, the cooking zones of the unheated heating bodies have a low temperature and therefore can be touched without danger of burning oneself, which is not true with regard to the cooking zone of the heated heating body. Nevertheless, this can generally not be noted from looking at the cooking surface. The temperature within the region of radiation of the heating body is about 700° C. Safe touching is possible, however, only at temperatures which are below about 60° C.

In order to regulate or limit the heating temperature of the heating body it is already known to provide between it and the cooking surface a temperature sensor which consists of a rod of a material which is resistant to high temperatures and has a high coefficient of thermal expansion, for instance a nickel-chromium alloy, contained within a tube consisting of a material of low coefficient of thermal expansion, for instance quartz glass or ceramics. The one end of the rod is in communication with a switch system which serves to regulate or limit the temperature of the heating body, while the other end is connected in non-displaceable manner with the tube so that the first-mentioned end of the rod extends out of the tube to a greater or lesser extent depending on the surrounding temperature and is thus subject to an axial movement produced by temperature which is employed to actuate the switch system by which, for instance, in case of regulation, the heating circuit is connected at a correspondingly low temperature and then disconnected at a correspondingly high temperature so that the heating temperature is maintained at a desired value.

In order to warn against touching too hot a point of the cooking surface, so-called "hot warning" devices have become known. In this case a thermal sensor which is in communication with a switch system connected with a signal device is arranged below the cooking surface. This hot warning is so designed that the signal device is actuated at temperatures of the cooking surface which are, for instance, above 60° C. so that the signal device indicates that touching the cooking entails the danger of being burned. This warning may be optical or acoustic. The devices for the "hot warning" can be distributed below the cooking surface, in which connection those regions of the cooking surface which can be touched without danger and those which cannot can be made evident, for instance, optically by means of small light bulbs.

One device for hot warning and for regulating or limiting the temperature of radiation or contact heating bodies of the type described above is already known from U.S. Pat. No. 3,906,424. In that case, the transmission member which is connected to the free end of the rod is developed in angular shape and is mounted under spring action on the supporting body of the switch contacts within the region where the two arms come together. As a result of the axial expansion of the rod the transmission member is tilted and the free arm not connected with the rod effects a closing or opening of the switch contacts via insulating bodies and leaf springs. Due to the spring mounting of the transmission member, however, the temperature control is inaccurate. These inaccuracies are further increased by the fact that both the transmission of force from the transmission member and the opening of the heating circuit are effected solely by means of leaf springs which become fatigued, in particular, after a longer period of use.

The object of the present invention is to create a device of the aforementioned type which while being of simple construction permits a reliable opening and closing of the contacts at temperatures which are constant in each case.

This result is achieved, in accordance with the invention, in the manner that the transmission member, which has two parts of different cross section, is arranged as a direct extension of the rod, preferably coaxial with it, the larger part which adjoins the rod having a first actuating surface in the region of transition to the part of smaller cross section and, on the free end of the smaller part, a second actuating surface for actuating the switch system. With a transmission member developed in this way as extension of the rod, an axial expansion, no matter how small it may be, will still be transmitted accurately to the switch system so that contact actuation is possible in each case within a constant, minimum temperature range. By the use of special materials for the transmission member, which is made relatively short, for instance ceramics, any uncontrollable inherent expansion caused by the high heating temperatures is also minimum and the use of metal is not absolutely necessary in view of the favorable direct transmission of force. Since both the actuating surfaces for the opening and closing of the corresponding switch are provided directly on the transmission member, a development which is also particularly simple from a structural standpoint is also possible, and thus use which is practically free of disturbance.

The distance between the first actuating surface of the transmission member and the actuating point of a movable contact spring of the switch system serving for the regulation or limiting of the temperature is preferably greater than the distance between the second actuating surface of the transmission member and the place of actuation of a movable contact spring of the switch system serving for the hot warning.

By this measure, dependable assurance is provided that when the cooking apparatus is placed in operation the signal device will always be connected to "hot warning" during the course of the increase in temperature since the limit temperature for the hot warning is reached far earlier than the heating temperature. When the cooking apparatus is placed out of operation, the switch system serving for the hot warning is actuated during the course of the drop in temperature only when the temperature drops below the temperature which leads to the hot warning.

In accordance with another development of the invention, in order to adjust the switch temperature of the switch system serving for the regulating or limiting of the temperature of the heating body, the end of the rod which is in communication with the transmission member has a collar and the other end of the rod has a thread, a compression spring being arranged between the collar and the one end of the tube containing the rod and a nut being screwed onto the thread of the rod, the nut resting against the other end of the tube which contains the rod.

Due to the compression spring, the rod is under tensile stress within the tube so that by simply turning the nut an accurate adjustment of the switch system which serves for the regulating or limiting of the temperature of the heating body is obtained. To be sure, the switch temperature leading to the hot warning is also changed by this adjustment. The adjustment of the switch system which serves for the hot warning can take place, for instance, by the bending of the contact holders of this switch system, but also in any other manner already known.

In accordance with another advantageous embodiment of the invention, a relief spring is provided which acts in opposition to the direction of expansion of the rod and rests against the second actuating surface, said spring being developed, under displacement by the transmission member, to relax the contact spring provided for closing the contact of the signal device. In this way there is obtained, on the one hand, a reliable return of the transmission member after the cooling of the rod and, on the other hand, an immediate closing of the contact for the signal device.

Further details of the invention will become evident from the drawing in which one embodiment is, inter alia, shown.

Figure 3:
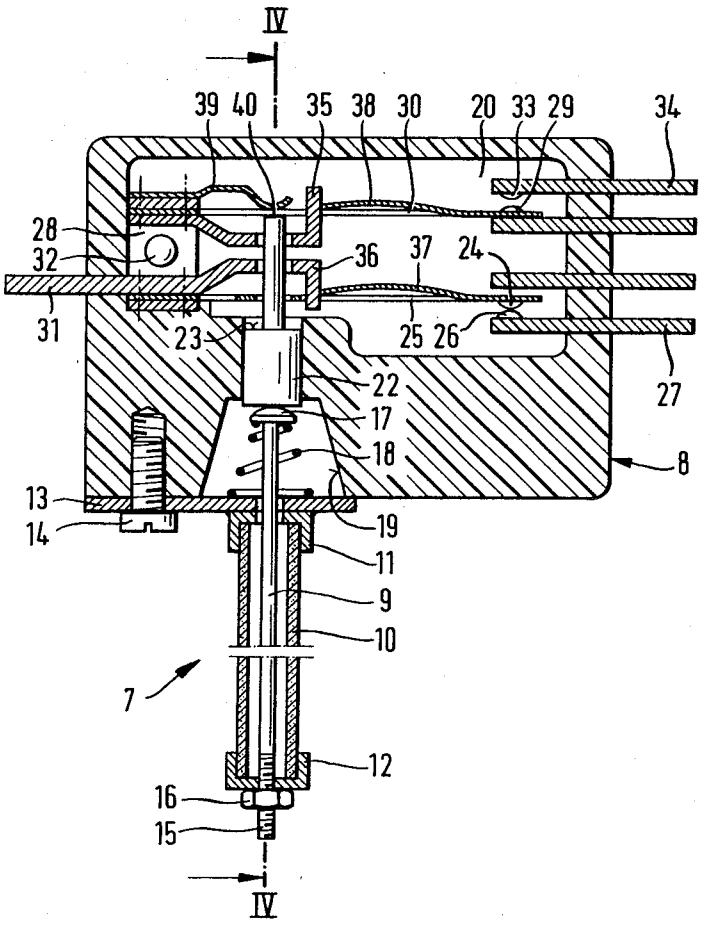

FIG. 1 is a section along the line I—I of FIG. 2 through a heating body having a device in accordance with the invention; FIG. 2 is a top view of the heating body of FIG. 1; FIG. 3 is a section along the line III—III of FIG. 4 through a device in accordance with the invention; and FIG. 4 is a section along the line IV—IV of FIG. 3.

FIGS. 1 and 2 show a radiation heating body 1 which consists of a pot 2 within which there is a spirally placed heating coil 3 which is embedded in an embedment composition 4. The radiation heating body 1 is arranged below the plate 5 of metal, glass ceramics or the like which forms the cooking surface 6. Between the cooking surface 6 and the heating coil 3 there is a temperature sensor 7 which is in communication with a switch head 8 bearing the switch system, the temperature sensor 7 being passed in simple manner through two holes in the radiation heating body 1.

The temperature sensor 7 is thus exposed to the temperature which prevails below the cooking surface 6 in the radiation space between the cooking surface 6 and the heating coil 3.

In FIGS. 3 and 4, the unit consisting of the temperature sensor 7 and the switch head 8 is shown separately. The temperature sensor 7 has a rod 9 consisting of a material which is resistant to high temperatures and has a high coefficient of thermal expansion, for instance a nickel-chromium alloy, which is arranged within a tube 14 of a material which is resistant to high temperatures and has a low coefficient of thermal expansion, for instance quartz glass or ceramics, which forms a covering for the rod 9. The ends of the tube 10 bear caps 11, 12, the cap 11 being fastened to a base plate 13 which is screwed by a screw 14 to the switch head 8. The rod 9 passes through holes in the cap 11, the base plate 13 and the cap 12 and at the end located at the cap 12 it has a thread 15 onto which there is screwed a nut 16 which rests against the cap 12. The other end of the rod 9 has a bulged collar 17. Between the collar 17 and the base plate 13, and thus between the collar 17 and the one end of the tube 10 containing the rod 9, there is arranged a compression spring 18 which keeps the rod 9 under tensile stress and thus presses the nut 16 against the outside of the cap 12.

The rod 9, the tube 10, the caps 11, 12, the nut 16, the base plate 13 and the compression spring 18 form a sensor unit which is screwed by the screw 14 to the switch head 8, the switch head 8 having a cutout (recess) 19 into which the end of the rod 9 having the compression spring 18 is inserted.

The switch head 8 forms a housing 20 which is open to one side, the open side being covered by a cover plate 21. The inside of the housing 20 is in communication with the cutout 19 via a hole which extends at least approximately coaxially with the rod 9 and within which there is a transmission member 22 which is displaceable axially in the hole. The one end of the transmission member 22 rests, in the position shown in FIGS. 3 and 4 due to the weight of the transmission member 22 itself, on the curved surface of the collar 17.

The transmission member 22 has an actuating surface 23 in the form of a milling for the actuating of the switch system which serves to control the temperature, said system having a contact spring 25 which bears the movable contact 24 and a connection lug 27 bearing the stationary contact 26. The contact spring 25 is firmly connected to a spring holder 28 which also bears the contact spring 30 having the movable contact 29, and is connected in electrically conductive manner to a connection lug 31 and fastened to the switch head 8 by a rivet 32. The stationary contact 33 for the contact spring 30 is fastened to a connection lug 34. In addition, the spring holder 28 has two extensions 35, 36 which represent knife-edge mounts for central parts 37, 38 bent out of the contact spring 25, 30 so that the contract springs 25, 30 form snap springs, known per se.

Finally, a relief spring 39 is fastened to the spring holder 28 together with the contact spring 30, said relief spring pressing in the direction towards the transmission member 22 against the contract spring 30, which in itself has initial stress as a result of which the contact spring 30 urges the movable contact 29 against the stationary contact 33.

The two extensions 35, 36 and the contact spring 30 have openings through which the part of the transmission member 22 adjoining the actuating surface 23 extends and its front end represents the actuating surface 40 for the switch system which serves for the hot warning and is formed of the contact spring 30, the relief spring 39, the movable contact 29 and the stationary contact 33. The actuating surface 40 lies opposite the point of actuation of the movable contact spring 30 of the switch system serving for the hot warning, said actuating point being formed by the point of the relief spring 39 which lies opposite the actuating surface 40. The actuating point of the movable contact spring 25 of the switch system which serves for regulating the temperature is located on the contact spring 25 opposite the actuating surface 23 of the transmission member 22. It is clear that in this embodiment the distance a between the actuating surface 23 of the transmission member 22 and the point of actuation of the movable contact spring 25 of the switch system serving to regulate the temperature of the heating body is greater than the distance b of the actuating surface 40 of the transmission member 22 from the point of actuation, lying on the relief spring 39, of the movable contact spring 30 of the switch system serving for the hot warning.

The connection lugs 31, 27 are connected, together with the heating coil 3 of the heating body 1 (FIGS. 1, 2), to a current supply network via a switch (not shown). The signal device for the hot warning is in series with the connecting lugs 31, 34 and is connected via them, bypassing the switch for the heating circuit, also to the current supply network.

In the condition of rest shown in FIGS. 3 and 4, the contacts 24, 26 are closed and the contacts 29, 33 open. The circuit for the hot warning is thus open.

If the above-mentioned switch is actuated in order to connect the heating circuit, then the heating coil 3 of the heating body is heated, as a result of which the temperature increases in the space between the cooking surface 6 and the heating coil 3. The rod 9 expands so that the transmission member 22 is moved towards the actuation point of the relief spring 39. Upon reaching a temperature of, for instance, less than 60° C., the actuating surface 40 of the transmission member 22 presses against the relief spring 39, as a result of which the relief spring 39 would be moved away from the contact spring 30 but due to its initial tension the contact spring 30 follows along in this movement of the relief spring 39. When the contact spring 30 passes beyond the support of the central part 38 thereof on the extension 35, for instance at a temperature of 60° C., the contacts 29, 30 are suddenly closed so that the signal device for the hot warning is connected.

If the temperature in the space between the cooking surface 6 and the heating coil 3 reaches a temperature, for instance, of 700° C., then the actuating surface 23 of the transmission member 22 strikes against the contact spring 25 which, upon moving beyond the position of the support of the middle part 37, suddenly interrupts the contacts 24, 26 so that the heating is disconnected. The signal device for the hot warning remains on. If the rod 9 decreases in length during the course of the following cooling, then the contact spring 25 snaps back again into the position in which the contacts 24, 26 are closed.

This cycle is repeated as long as the switch of the heating circuit is connected. If it is opened, the contacts 24, 26 are closed, to be sure, during the course of the cooling, but no additional heating takes place, so that the rod 9 becomes shorter and shorter. When the temperature within the space between the cooking surface 6 and the heating coil 3 has dropped to such an extent that the contact spring 30 goes beyond the mounting point of the central part 38, which is the case, in the event of suitable adjustment, at a temperature at which no burning could result in the event of contact with the cooking surface 6, the contact spring 30 snaps into the position shown in FIG. 3, the contacts 29, 33 being opened and the signal device serving for the hot warning being disconnected so that it can be noted that the cooking surface 6 of the heating body 1 can be touched without danger.

As already mentioned, the adjusting of the switch system 25, 24, 26 for a given temperature to be produced by the heating body 1 is effected by turning the nut 16 on the thread 15 of the rod 9, and the adjustment of the switch system 30, 34, 29 for the limit temperature indicated by the signal device is effected, for instance, by bending the end of the connection lug 34 bearing the contact 33, which can be effected in simple manner since the inside of the housing 20 is accessible upon removal of the cover plate 21. However, any other known adjusting measures or devices can of course also be used, such as displaceable screws, squeeze plates or the like.

The invention is not limited to the embodiment shown in the drawing. Thus the device may also be developed as a temperature limiter in which the switch system which controls the heating temperature opens the heating circuit when a maximum temperature is reached and does not automatically reconnect it.

I claim:

1. In a device for "hot warning" and for regulating and limiting the temperature of radiation or contact heating bodies of electric heating apparatuses in combination with heating surfaces made of metal, glass, ceramics and the like, in which an outer end of a temperature sensor is arranged between the heating body and the cooking surface in order to regulate and limit the temperature of the heating body, said sensor having a rod made of a material with a high coefficient of thermal expansion disposed in a tube made of a material of a low coefficient of thermal expansion, said device including a switch head, an inner end of the rod extending to the switch head and being in communication via a transmission member with a switch system, the switch system serving for the regulating and limiting of the temperature of the heating body and for operation of a signal device, an outer end of the rod being joined to an outer end of the tube, an inner end of the tube connecting with the switch head, the improvement wherein the transmission member has a first part of larger cross section and a second part of smaller cross section, the transmission member being disposed as a direct extension of the rod and coaxial thereto, said first part of the transmission member directly adjoining the rod and having, adjacent a transition region to said second part, a first actuating surface and, on a free end of said second part, a second actuating surface for actuating different components of the switch system at different temperatures, said first and said second parts being disposed about a common axis for transmitting a force of said rod directly along said axis to said components of said switch system.

2. The device according to claim 1, wherein the switch system includes a first movable contact spring and a second movable contact spring, a distance between the first actuation surface of the transmission member and a point of actuation of the first movable contact spring of the switch system which serves to regulate and limit the temperature is greater than a distance between the second actuating surface of the transmission member and a point of actuation of said second movable contact spring of the switch system which serves for the hot warning.

3. The device according to claim 2, wherein in order to adjust the switch temperature of a portion of the switch sytem which serves for the regulating and limiting of the temperature of the heating body, said inner end of the rod which is in communication with the transmission member comprises a collar and said outer end of the rod comprises a thread, there being a compression spring disposed between the collar and one end of said tube, and wherein said device further comprises a nut screwed on the thread of the rod, the nut resting against the other end of the tube.

4. The device according to claim 3, wherein said switch system has a contact spring provided for the closing of a contact of the signal device, and further comprises a relief spring which acts against a direction of expansion of the rod and rests against the second actuating surface, said relief spring serving upon displacement by the transmission member, to relax said contact spring of said switch system.

5. The device according to claim 2, wherein said switch system has a contact spring provided for the closing of a contact of the signal device, and further comprises a relief spring which acts against a direction of expansion of the rod and rests against the second actuating surface, said relief spring serving upon displacement by the transmission member, to relax said contact spring of said switch system.

6. The device according to claim 1, wherein said switch system has a contact spring provided for the closing of a contact of the signal device, and further comprises a relief spring which acts against a direction of expansion of the rod and rests against the second actuating surface, said relief spring serving upon displacement by the transmission member, to relax said contact spring of said switch system.

7. The device according to claim 1, wherein in order to adjust the switch temperature of a portion of the switch system, said inner end of the rod which is in communication with the transmission member comprises a collar and said outer end of the rod comprises a thread, there being a compression spring disposed between the collar and one end of said tube, and wherein said device further comprises a nut screwed on the thread of the rod, the nut resting against the other end of the tube.

8. The device according to claim 7, wherein said switch system has a contact spring provided for the closing of a contact of the signal device, and further comprises a relief spring which acts against a direction of expansion of the rod and rests against the second actuating surface, said relief spring serving upon displacement by the transmission member, to relax said contact spring of said switch system.

9. The device according to claim 1, wherein said first part of said transmission member is slidably mounted within a hole of said switch head to be guided in movement coaxially to said rod, said hole is coaxial to said rod and has a diameter substantially equal to that of said first part of said transmission member.

10. The device according to claim 9, wherein said switch head includes a cut-out located between said hole and said inner end of said tube, there being a helical spring disposed in said cut-out coaxial to said rod, said inner end of said rod comprising a collar abutting said first part of said transmision member and extending radially outwardly to engage said spring, said spring being held in compression between said collar and said inner end of said tube.

11. The device according to claim 10, wherein said switch system components extend in a direction transverse to the axis of said rod so as to be deflected by an axially longitudinal movement of said transmission member and the inner end of said rod.

12. The device according to claim 10, wherein the length of said hole is substantially equal to that of the axial length of said first part of said transmission member.

13. The device according to claim 12, wherein said helical spring extends frustoconically from said collar toward said inner end of said tube.

14. The device according to claim 1, wherein said common axis of the transmission member and the axis of said rod are aligned in tandem.

* * * * *